United States Patent [19]

Dropczynski et al.

[11] 4,299,358

[45] Nov. 10, 1981

[54] METHOD AND APPARATUS FOR THE AUTOMATIC SIDEWISE INSERTION OF CORES IN WINDING MACHINES

[75] Inventors: Hartmut Dropczynski, Dormagen; Manfred Dienst, Neuss, both of Fed. Rep. of Germany

[73] Assignee: Jagenberg-Werke A.G., Düsseldorf, Fed. Rep. of Germany

[21] Appl. No.: 112,969

[22] Filed: Jan. 17, 1980

[30] Foreign Application Priority Data

Jan. 22, 1979 [DE] Fed. Rep. of Germany ..... 2902262

[51] Int. Cl.[3] ..... B65H 75/02; B65H 19/20

[52] U.S. Cl. ..... 242/55; 242/56 R; 242/56 A

[58] Field of Search ..... 242/55, 56 A, 56 R, 242/68.5

[56] References Cited

U.S. PATENT DOCUMENTS

| | | | |
|---|---|---|---|
| 2,772,838 | 12/1956 | Lenz | 242/55 |
| 3,161,363 | 12/1964 | Press | 242/56 A |
| 3,610,545 | 10/1971 | Reifenhauser | 242/56 R |
| 3,720,381 | 3/1981 | Rehme | 242/56 R |
| 3,848,824 | 11/1974 | Schijndel | 242/56 A |

*Primary Examiner*—Edward J. McCarthy

*Attorney, Agent, or Firm*—Sprung, Felfe, Horn, Lynch & Kramer

[57] ABSTRACT

A method for the automatic sidewise pushing of a plurality of cores of any desired length into the wedge formed by the supporting rolls of an arborless winding machine, comprising measuring the length of the first core to be inserted, retracting a retractable pusher into a position just back of the rear end of the first core which has been measured and is ready to be transferred, moving the core to a feed track, advancing the pusher to push the core into the wedge, and repeating the process until all cores have been inserted. An apparatus is provided to carry out the method automatically.

3 Claims, 2 Drawing Figures

METHOD AND APPARATUS FOR THE AUTOMATIC SIDEWISE INSERTION OF CORES IN WINDING MACHINES

BACKGROUND OF THE INVENTION

The invention relates to a method and an apparatus for the automatic sidewise insertion of one or more cores of any desired length into the wedge formed by the supporting rolls of arborless winding machines.

It is known practice to insert from the side cores of any desired length and of different lengths into the wedge formed by the supporting rolls in machines for the arborless winding of webs of material. This may be done by pushing the cores manually and successively in the desired sequence from the side into the machine, or by placing the cores successively on a feed track and then pushing them into the machine all at once. Both methods are rather time-consuming; and in the latter case the feed track must be of considerable length.

SUMMARY OF THE INVENTION

The present invention has as its object to provide a method and an apparatus which simplify and accelerate the insertion of cores and thus minimize machine downtime.

With a view to accomplishing this object, a method is proposed wherein the length of each core to be inserted is measured, the pusher is retracted into a position just back of the rear end of the core which has been measured and is ready to be transferred, and the core is moved onto the feed track and inserted by the advancing pusher.

This method in accordance with the invention permits the cores to be inserted in rapid sequence, control of the return stroke of the pusher to a position determined by the length of the next core to be inserted eliminating needless motion and hence waste of time.

A preferred apparatus for carrying out the method in accordance with the invention is characterized by a pusher adapted to move back and forth automatically along a feed track between variable end positions; by a transfer means, disposed parallel to the feed track, for the cores to be moved individually and successively, with their axes parallel, from the feed table to the feed track; and by a length-measuring means for the cores which is coupled to the transfer means, there being connected to the measuring means a control means which sets the particular end position during the return stroke of the pusher on the basis of the measured length of the core which is ready to be transferred.

In an advantageous embodiment of the apparatus in accordance with the invention, the length-measuring means consists of a plurality of plates which are spaced from and parallel to one another and are mounted to be tiltable toward the feed track, and each of which in its end position operates a switch delivering a signal to the control means, a transfer means being provided which holds or releases a core, depending on the position of the pusher.

The cores to be inserted move successively from a feed table to the length-measuring means for transfer and are measured for their length before they are transferred. The pusher then moves from its forward end position into a rearward end position which, based on the measured length of the core ready to be transferred, is just back of the latter's rear end. The core is then released, moves onto the feed track, and is pushed sideways into the winding machine by the advancing pusher. The pusher then moves back into a rearward end position which is determined by the measured length of the next core, now ready to be transferred. Thus the measurement of the length of the core serves as a signal for controlling the length of the return stroke of the pusher. The transfer means releases the core as soon as the pusher has reached its rearward end position, and then immediately returns into its holding position in order to hold the next core delivered to it until the preceding core has been inserted by the pusher and the latter has returned into its end position.

BRIEF DESCRIPTION OF THE DRAWINGS

The invention will now be explained in greater detail with reference to the accompanying drawing illustrating an embodiment of the apparatus in accordance with the invention, wherein.

DETAILED DESCRIPTION OF THE INVENTION

Figure 1:
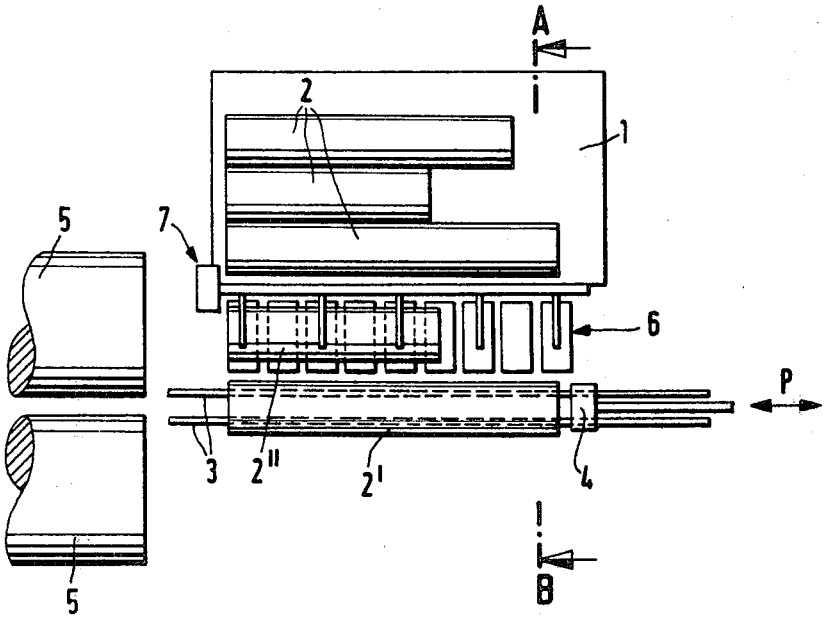
FIG. 1 is a top plan view.

Disposed on a feed table 1 with their axes parallel are a plurality of cores 2 but to random lengths. While one of the cores 2 is on the feed track 3 and is being pushed by the pusher 4, adapted to move back and forth in the directions indicated by the arrow P, from the side toward the wedge formed by the supporting rolls 5 of the winding machine, the next core 2 is ready for transfer in a transfer and length-measuring means.

Figure 2:
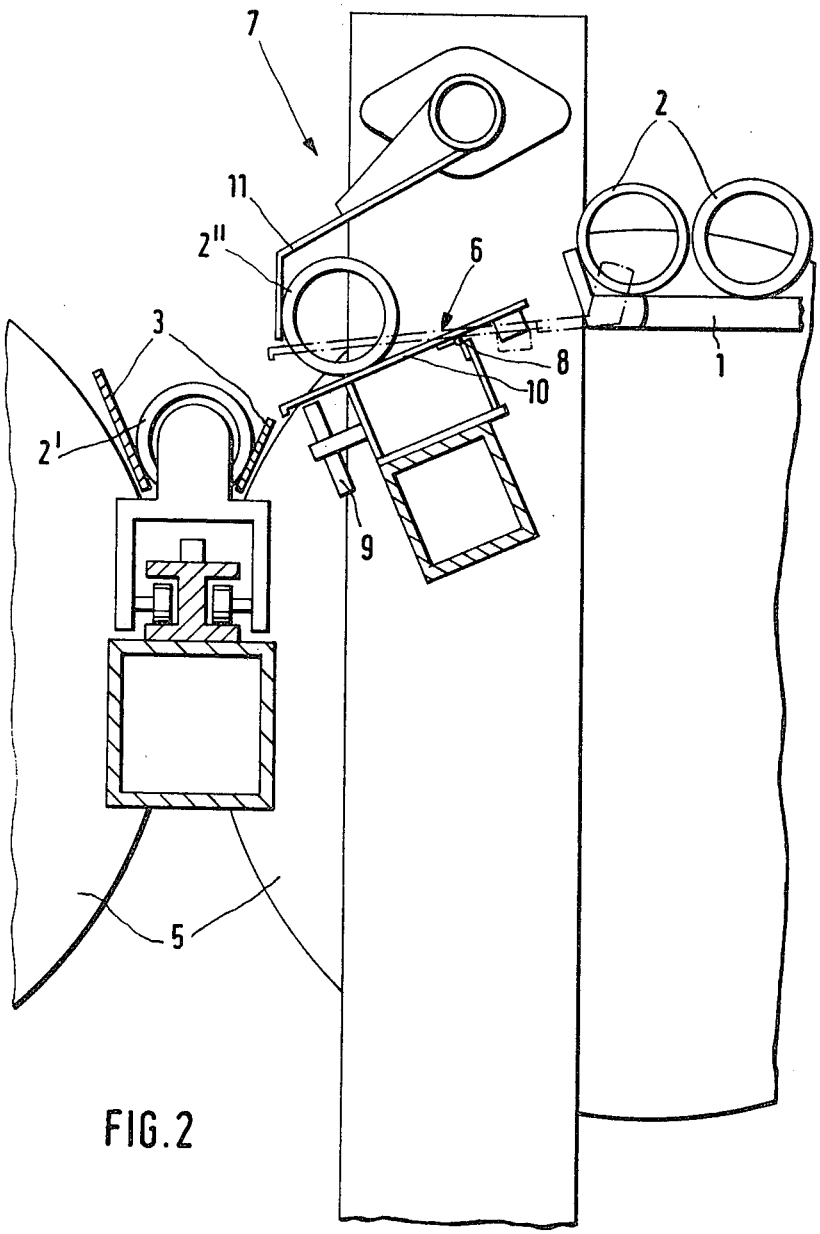
FIG. 2 is a cross-sectional view taken along the line A-B in FIG. 1.

The cores 2 advanced at right angles to their longitudinal axes in synchronism with the feed stroke of the pusher 4 successively reach the transfer and length-measuring means. The length-measuring means 6 consists of a plurality of plates 10 arranged side by side and mounted to be tiltable toward the feed track 3, and the transfer means 7 is formed by a plurality of swinging holders 11. When a core 2 is delivered to the transfer and length-measuring means 6 and 7, the transfer means 7 is in the holding position shown in FIG. 2, in which transfer of the core 2 to the feed track 3 is prevented. The tipping of the plates 10 is brought about by the weight of the core 2″ as the latter rolls over the hinge pin 8 of the plates 10.

As they tip, the plates 10 operate a switch 9, such as a proximity switch, for example. The pulses so triggered are applied to a control means. The number of plates tipped, and hence the number of pulses fed to the control means, depends on the length of the core 2.

On the basis of the number of pulses transmitted by the length-measuring means and stored in the control means, the latter controls the return stroke of the pusher 4 to such rearward end position that the pusher stops just back of the rear end of the core 2″ which has been measured and is ready to be transferred. The core 2″ is released by the holders 11 as the pusher reaches its rearward end position and operates a limit switch, which triggers the release of the core 2″. The latter then rolls onto the feed track 3 and the holders 11 return into their holding position; and while the next core 2 is being moved to the transfer and length-measuring means 6 and 7, the pusher 4 pushes the core 2′ located on the feed track 3 into the winding machine.

The apparatus in accordance with the invention is of simple construction, has a short overall length which need not exceed that of the longest core handles, and permits the rapid introduction of the cores into the winding machine.

It will be appreciated that the instant specification and claims are set forth by way of illustration and not limitation, and that various changes and modifications may be made without departing from the spirit and scope of the present invention.

What is claimed is:

1. A method for the automatic sidewise pushing of a plurality of cores of any desired length into the wedge formed by the supporting rolls of an arborless winding machine, comprising measuring the length of the first core to be inserted, retracting a retractable pusher into a position just back of the rear end of the first core which has been measured and is ready to be transferred, moving the core to a feed track, advancing the pusher to push the core into the wedge, and repeatng the process until all cores have been inserted.

2. An apparatus for carrying out the method according to claim 1, comprising an arborless winding machine including supporting rolls forming a wedge, a feed table for holding a plurality of cores of any desired length, a feed track aligned with the wedge, a pusher adapted to move back and forth automatically along said feed track between variable end positions, means disposed parallel to the feed track for transferring the cores individually and successively with their axes parallel from the feed table to the feed track, means for measuring the lengths of the cores and operatively coupled to the transfer means, and control means connected to the measuring means so as to set the particular end position for the return stroke of the pusher on the basis of the measured length of the core which is ready to be transferred.

3. An apparatus according to claim 2, wherein the length measuring means comprises a plurality of parallel spaced plates tiltably mounted toward the feed track, a switch for each plate, the presence of a roll on a plate tilting the plate to close its switch, those switches which are activated serving to set the particular end position for the return stroke of the pusher.

* * * * *